US010113827B2

(12) United States Patent
Elsner

(10) Patent No.: US 10,113,827 B2
(45) Date of Patent: Oct. 30, 2018

(54) FIREARM RECOIL CONTROL SYSTEM

(71) Applicant: Jeff Elsner, McFarland, WI (US)

(72) Inventor: Jeff Elsner, McFarland, WI (US)

( * ) Notice: Subject to any disclaimer, the term of this patent is extended or adjusted under 35 U.S.C. 154(b) by 0 days.

(21) Appl. No.: 15/441,491

(22) Filed: Feb. 24, 2017

(65) Prior Publication Data

US 2017/0321986 A1 Nov. 9, 2017

Related U.S. Application Data

(60) Provisional application No. 62/299,341, filed on Feb. 24, 2016.

(51) Int. Cl.

| | |
|---|---|
| ***F41A 23/08*** | (2006.01) |
| ***F41A 25/00*** | (2006.01) |
| ***F41A 23/06*** | (2006.01) |
| *F41C 23/06* | (2006.01) |

(52) U.S. Cl.
CPC ..... *F41A 23/08* (2013.01); *F41A 25/00* (2013.01); *F41C 23/06* (2013.01)

(58) Field of Classification Search
CPC ..... F41A 23/04; F41A 23/06; F41A 23/08; F41A 23/10; F41A 23/12; F41A 23/14; F41A 25/02; F41A 25/04; F41A 25/06; F41A 25/08; F41A 25/10; F41A 25/12; F41A 25/14; F41A 25/16; F41A 25/18; F41A 25/20; F41A 25/22; F41A 25/24
USPC ..... 89/42.01, 43.01, 44.01, 44.02
See application file for complete search history.

(56) References Cited

U.S. PATENT DOCUMENTS

| | | | | |
|---|---|---|---|---|
| 2,598,017 A * | 5/1952 | Rockwell | ..... | F41A 25/10 89/44.02 |
| 4,580,483 A | 4/1986 | Garbini | | |
| 4,625,620 A | 12/1986 | Harris | | |
| 4,841,839 A | 6/1989 | Stuart | | |
| 4,893,545 A * | 1/1990 | Sanderson | ..... | F41A 23/00 89/37.19 |

(Continued)

FOREIGN PATENT DOCUMENTS

| | | |
|---|---|---|
| GB | 1122869 A | 8/1968 |
| KR | 10-2014-0097930 A | 8/2014 |
| WO | 2010/062374 A1 | 6/2010 |

OTHER PUBLICATIONS

Written Opinion of the International Searching Authority dated Nov. 15, 2017 for related International Application No. PCT/US2017/019296 filed Feb. 24, 2017, 9 pages.

(Continued)

*Primary Examiner* — Bret Hayes
(74) *Attorney, Agent, or Firm* — Husch Blackwell, LLP

(57) ABSTRACT

A recoil control system includes a base portion having a main body with a flat bottom surface; a slide portion having a main body with a flat upper surface; at least one structure providing a sliding interface between the base portion and the slide portion such that the slide portion is slidingly engaged with, and can move forward and backward with respect to, the base portion; and a damper in communication with the slide portion. The recoil control system provides sliding interface between at least a portion of a firearm and at least a portion of a support used with the firearm and reduces the possibility of the support hopping or bouncing during recoil.

19 Claims, 8 Drawing Sheets

(56) References Cited

U.S. PATENT DOCUMENTS

| | | | | |
|---|---|---|---|---|
| 5,056,410 | A * | 10/1991 | Pitts | F41A 23/16 89/37.04 |
| 5,343,649 | A * | 9/1994 | Petrovich | F41A 25/04 42/1.06 |
| 5,354,024 | A | 10/1994 | Vinghog et al. | |
| 5,811,720 | A | 9/1998 | Quinnell et al. | |
| 7,143,986 | B1 * | 12/2006 | Austin | F41A 23/08 248/125.8 |
| 7,478,496 | B2 | 1/2009 | Bender | |
| 7,658,029 | B1 | 2/2010 | Moody et al. | |
| 8,006,426 | B1 | 8/2011 | Carroll | |
| 8,245,431 | B2 | 8/2012 | Werner | |
| 8,251,330 | B2 | 8/2012 | Stabler | |
| 8,327,570 | B2 | 12/2012 | Potterfield et al. | |
| 8,448,369 | B2 | 5/2013 | Hinds, Jr. | |
| 8,549,786 | B1 | 10/2013 | Griffith | |
| 8,973,296 | B1 | 3/2015 | Kocmich, IV | |
| 9,021,728 | B1 | 5/2015 | Kocmich et al. | |
| 9,140,512 | B2 | 9/2015 | Witchel | |
| 2006/0260460 | A1 * | 11/2006 | Plumier | F41A 25/22 89/37.01 |
| 2010/0282058 | A1 * | 11/2010 | Nelson | F41A 19/08 89/27.12 |
| 2011/0000363 | A1 * | 1/2011 | More | F41A 25/04 89/43.01 |
| 2012/0186126 | A1 | 7/2012 | Bartak | |
| 2012/0285062 | A1 | 11/2012 | Cama | |
| 2013/0074685 | A1 * | 3/2013 | Cottle | F41A 19/06 89/27.11 |
| 2014/0237882 | A1 | 8/2014 | Banes | |
| 2014/0325885 | A1 * | 11/2014 | Lim | F41A 25/02 42/1.06 |
| 2015/0354913 | A1 | 12/2015 | Morrow et al. | |
| 2016/0033239 | A1 * | 2/2016 | Bosscher | F41H 11/12 89/1.13 |
| 2016/0102945 | A1 * | 4/2016 | Itzkowitz | F41G 5/16 89/37.14 |
| 2016/0298922 | A1 * | 10/2016 | Duncan | F41A 23/02 |

OTHER PUBLICATIONS

International Search Report dated Nov. 15, 2017 for related International Application No. PCT/US2017/019296 filed Feb. 24, 2017, 3 pages.

* cited by examiner

FIREARM RECOIL CONTROL SYSTEM

CROSS-REFERENCE TO RELATED APPLICATIONS

This application is a non-provisional application of and claims priority to U.S. Provisional Patent Application No. 62/299,341 filed Feb. 24, 2016, which is incorporated herein in its entirety.

FIELD

The present disclosure relates to a recoil control system. In one embodiment, the disclosure relates to a firearm recoil control, and more particularly to firearm recoil control when using a bipod or other stationary platform.

BACKGROUND

When using a long rifle, AR platform rifle, shotgun or similar long firearm, it is common to use a bipod or other stationary platform to support the end of the firearm when shooting, particularly when targeting shooting. Bipods support a firearm by the stock or forearm to provide a stable base to improve accuracy compared to simply holding the firearm without support. While bipods do improve accuracy, they can be unstable during the recoil portion of the discharge of the firearm. When a firearm is discharged, the firearm recoils, or moves in a rearward motion toward the shooter. During recoil, the bipod slides along the shooting surface with the firearm motion and has a tendency to bounce or hop across the surface. As a result, bullets can travel errantly in a vertical direction.

One way to try and mitigate bouncing or hopping is to preload the firearm prior to firing by pressing one's shoulder against the stock of the firearm. This causes the bipod legs to flex so they will move during recoil.

Therefore, it would be desirable to provide a system or device used in combination with a firearm to mitigate the effect of recoil on shot accuracy when using a firearm with a bipod or other stationary platform. It is therefore also desirable to provide a system or device used in combination with a firearm to prevent or minimize the bounce or hop of a bipod during the recoil phase of a shot so that a bullet can exit the end of the barrel of a firearm prior to the bounce or hop.

SUMMARY

In an embodiment, a recoil control system is disclosed. According to embodiments of the present disclosure, a recoil control system comprises a base portion having a main body with a flat bottom surface; a slide portion having a main body with a flat upper surface; at least one structure providing a sliding interface between the base portion and the slide portion such that the slide portion is slidingly engaged with, and can move forward and backward with respect to, the base portion; and a damper in communication with the slide portion.

In another embodiment, a support for a firearm is disclosed. According to embodiments of the present disclosure, a support for a firearm comprises a mounting head; at least two legs connected to the mounting head, wherein each leg includes one foot at its distal end; and at least one recoil control system comprising a base portion having a main body with a flat bottom surface, a slide portion having a main body with a flat upper surface, at least one structure providing a sliding interface between the base portion and the slide portion such that the slide portion is slidingly engaged with, and can move forward and backward with respect to, the base portion, and a damper in communication with the slide portion.

In another embodiment, a recoil control system for a firearm is disclosed. According to embodiments of the present disclosure, a recoil control system for a firearm comprises a firearm having a long barrel and a stock; a support; and a recoil control device comprising a base portion having a main body with a flat bottom surface, a slide portion having a main body with a flat upper surface, at least one structure providing a sliding interface between the base portion and the slide portion such that the slide portion is slidingly engaged with, and can move forward and backward with respect to, the base portion, and a damper in communication with the slide portion.

Various other aspects, objects, features and embodiments of the present disclosure are disclosed with reference to the following specification, including the drawings.

Notwithstanding the above examples, the present disclosure is intended to encompass a variety of other embodiments including for example other embodiments as are described in further detail below as well as other embodiments that are within the scope of the claims set forth herein.

BRIEF DESCRIPTION OF THE DRAWINGS

Embodiments of the disclosure are disclosed with reference to the accompanying drawings and are for illustrative purposes only. The disclosure is not limited in its application to the details of construction or the arrangement of the components illustrated in the drawings. The disclosure is capable of other embodiments or of being practiced or carried out in other various ways. Like reference numerals are used to indicate like components. In the drawings.

DETAILED DESCRIPTION

Definitions

Figure 2:
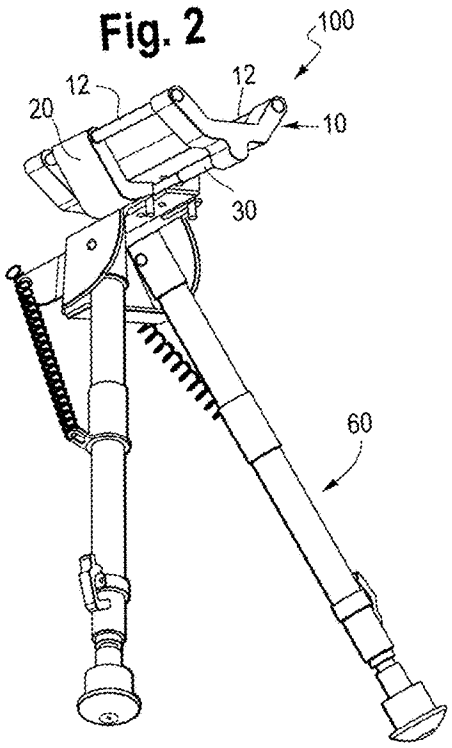
FIG. 2 is a perspective view of the recoil control system of FIG. 1 attached to a bipod in accordance with embodiments of the present disclosure.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, length etc., is from 100 to 1,000, it is intended that all individual values, such as 100, 101, 102, etc., and sub ranges, such as 100 to 144, 155 to 170, 197 to 200, etc., are expressly enumerated. For ranges containing values that are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, length and thickness of various components disclosed herein.

As used herein, recoil (often called knockback, kickback or simply kick) refers to the backward momentum of a gun when it is discharged. In technical terms, the recoil caused by the gun exactly balances the forward momentum of the projectile and exhaust gases (ejecta). Recoil is measured in something called a recoil pendulum, or calculated by mathematical formula based on Newton's physical law that says for every action there is an equal and opposite reaction. MV=MV (mass times velocity equals mass times velocity), the momentum must be equal on both sides of the equation.

The principle factors that must be considered to calculate recoil are bullet weight (mass), bullet velocity, powder charge, and firearm weight (mass). The mass times the velocity of everything ejected from the muzzle of a rifle (principally the bullet and powder gasses) will be equaled by the mass times the velocity of the recoiling firearm.

In an embodiment, the present disclosure provides a recoil control system. A recoil control system, as described herein, includes a base portion, a slide portion, at least one structure providing a sliding interface between the base portion and the slide portion and a shock absorber or damper in communication with the slide portion. As illustrated by the Figures, the base portion, slide portion at least one structure providing a sliding interface between the base portion and the slide portion, and damper can take various configurations. Moreover, the particular structures which enable the sliding engagement between the base portion and the slide portion may vary depending on the structure and configuration of the various components of the recoil control system. However, in each embodiment, the recoil control system provides a sliding interface between at least a portion of a firearm and at least a portion of a support. Various exemplary embodiments of a recoil control system are described in further detail below.

In one embodiment, the disclosure relates to the transfer of mechanical recoil forces from a firearm barrel to a recoil control system. In one embodiment, the disclosure relates to methods and devices for the transfer of mechanical recoil forces to a direction outside of the longitudinal axis of the firearm barrel.

In one embodiment, a recoil control system disclosed herein disperses or dissipates recoil forces and reduces the amount of force responsible for the upward movement or jerking that is characteristic of firearms.

In one embodiment, movement of the recoil control system, or a component thereof, will be approximately equal in magnitude, and with corresponding but opposite momentum from the forward force resulting from firing of the firearm. The net result is that the opposite movement or displacement of the recoil control system, or a component thereof, absorbs the recoil forces and prevents the firearm from being pushed rearward. In one embodiment, a sliding interface between at least a portion of a firearm and at least a portion of a support absorbs the recoil forces and prevents the firearm from being pushed rearward.

In yet another embodiment, at least a portion of the recoil forces is transferred to a sliding interface between at least a portion of a firearm and at least a portion of a support thereby significantly reducing or eliminating the component of recoil forces along the longitudinal axis of the firearm barrel, which is responsible, at least in part, to the reactive jerking of the firearm when fired.

In still another embodiment, a recoil control system disclosed herein can reduce recoil forces by at least 5%, or at least 10%, or at least 15%, or at least 20%, or at least 25%, or at least 30%, or at least 35%, or at least 40%, or at least 45%, or at least 50%, or at least 55%, or at least 60% or at least 65%, or at least 70%, or at least 75%, or at least 80%, or at least 85%, or at least 90%, or least 95% as compared to recoil forces observed without a recoil control system using the same firearm and the same ammunition.

In another embodiment, a recoil control system disclosed herein can reduce recoil forces from 5% to 95% or from 5% to 90% or from 5% to 85% or from 5% to 80% or from 5% to 75% or from 5% to 70% or from 5% to 65% or from 5% to 60% or from 5% to 55% or from 5% to 50% or from 5% to 45% or from 5% to 40% or from 5% to 35% or from 5% to 30% or from 5% to 25% or from 5% to 20% or from 5% to 15% or from 5% to 10% as compared to recoil forces observed without a recoil control system using the same firearm and the same ammunition.

In another embodiment, a recoil control system disclosed herein can reduce recoil forces from 10% to 95% or from 15% to 95% or from 20% to 95% or from 25% to 95% or from 30% to 95% or from 35% to 95% or from 40% to 95% or from 45% to 95% or from 50% to 95% or from 55% to 95% or from 60% to 95% or from 65% to 95% or from 70% to 95% or from 75% to 95% or from 80% to 95% or from 85% to 95% or from 90% to 95% as compared to recoil forces observed without a recoil control system using the same firearm and the same ammunition.

In another embodiment, a recoil control system disclosed herein can reduce the vertical spread of a shot group by at least 20%, or at least 25%, or at least 30%, or at least 35%, or at least 40%, or at least 45%, or at least 50%, or at least 55%, or at least 60% or at least 65%, or at least 70%, or at least 75%, or at least 80%, or at least 85%, or at least 90%, or least 95% as compared to vertical spread observed without a recoil control system using the same firearm and the same ammunition.

In another embodiment, a recoil control system disclosed herein can reduce vertical spread of a shot group from 10% to 95% or from 10% to 90% or from 10% to 85% or from 10% to 80% or from 10% to 75% or from 10% to 70% or from 10% to 65% or from 10% to 60% or from 10% to 55% or from 10% to 50% or from 10% to 45% or from 10% to 40% or from 10% to 35% or from 10% to 30% or from 10% to 25% or from 10% to 20% or from 10% to 15% as compared to vertical spread observed without a recoil control system using the same firearm and the same ammunition.

In another embodiment, a recoil control system disclosed herein can reduce vertical spread of a shot group from 15% to 95% or from 20% to 95% or from 25% to 95% or from 30% to 95% or from 35% to 95% or from 40% to 95% or from 45% to 95% or from 50% to 95% or from 55% to 95% or from 60% to 95% or from 65% to 95% or from 70% to 95% or from 75% to 95% or from 80% to 95% or from 85% to 95% or from 90% to 95% as compared to vertical spread observed without a recoil control system using the same firearm and the same ammunition.

In another embodiment, a recoil control system disclosed herein can reduce the horizontal spread of a shot group by at least 20%, or at least 25%, or at least 30%, or at least 35%, or at least 40%, or at least 45%, or at least 50%, or at least 55%, or at least 60% or at least 65%, or at least 70%, or at least 75%, or at least 80%, or at least 85%, or at least 90%, or least 95% as compared to the horizontal spread observed without a recoil control system using the same firearm and the same ammunition.

In another embodiment, a recoil control system disclosed herein can reduce the horizontal spread of a shot group from 10% to 95% or from 10% to 90% or from 10% to 85% or from 10% to 80% or from 10% to 75% or from 10% to 70% or from 10% to 65% or from 10% to 60% or from 10% to 55% or from 10% to 50% or from 10% to 45% or from 10% to 40% or from 10% to 35% or from 10% to 30% or from 10% to 25% or from 10% to 20% or from 10% to 15% as compared to the horizontal spread observed without a recoil control system using the same firearm and the same ammunition.

In another embodiment, a recoil control system disclosed herein can reduce the horizontal spread of a shot group from 15% to 95% or from 20% to 95% or from 25% to 95% or from 30% to 95% or from 35% to 95% or from 40% to 95% or from 45% to 95% or from 50% to 95% or from 55% to 95% or from 60% to 95% or from 65% to 95% or from 70% to 95% or from 75% to 95% or from 80% to 95% or from 85% to 95% or from 90% to 95% as compared to the horizontal spread observed without a recoil control system using the same firearm and the same ammunition.

Figure 1:
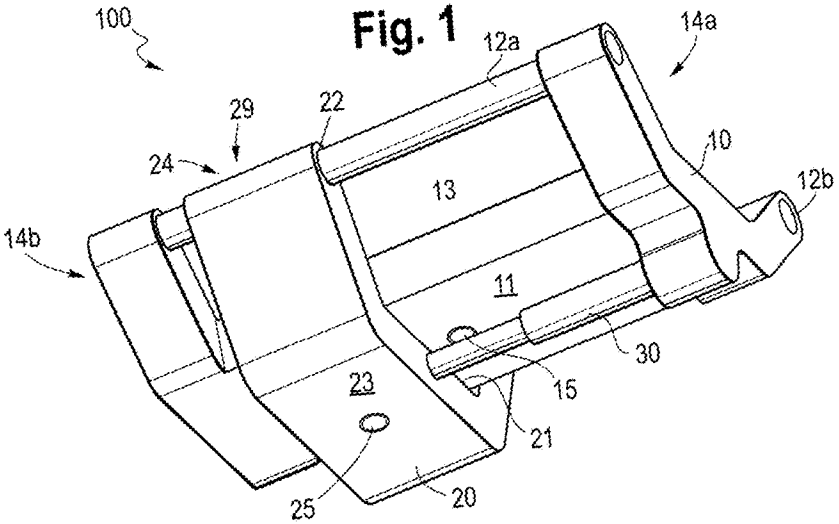
FIG. 1 is a perspective view of a recoil control system in accordance with embodiments of the present disclosure.

FIG. 1 illustrates an exemplary first exemplary embodiment of a recoil control system 100. The recoil control system 100 includes the base portion 10, slide portion 20, at least one structure 12 providing a sliding interface between the base portion 10 and the slide portion 20, and damper 30. The slide portion 20 is slidingly engaged with the base portion 10 by way of the at least one structure 12 providing a sliding interface between the base portion 10 and the slide portion 20.

In the embodiment shown in FIG. 1, the at least one structure 12 providing a sliding interface between the base portion 10 and the slide portion 20 is composed of two rods 12*a*, 12*b*. Each of the rods 12*a*, 12*b* is connected to the base portion 10, and the slide portion 20 engages the rods 12*a*, 12*b*. The slide portion 20 travels along rods 12*a*, 12*b* forward and backward with respect to the base portion 10.

Turning to the structure of the base portion 10 and slide portion 20 in particular, as shown in FIG. 1, the base 10 has a main body 13 with a smooth bottom surface 11 and two pairs of legs 14*a*, 14*b* extending upwardly away from the main body 13 at an angle. The sliding rods 12*a*, 12*b* extend between the pairs of legs 14*a*, 14*b* parallel with the length of the body 13.

In the embodiment shown, the slide portion 20 also has a main body 23. In an embodiment, as shown in FIGS. 1-4, the length of the main body 23 is less than the length of the main body 13 of the base portion 10. As also shown in FIG. 1, the main body 23 has a smooth upper surface 21 which corresponds to the smooth lower surface 11 of the main body 13 of the base portion 10. The slide portion 20 also includes a single pair of legs 24 extending upwardly away from the main body 23 at an angle. In an embodiment, the angle is within 5° of the angle at which the pairs of legs 14*a*, 14*b* extend from the main body 13 of the base 10. Each leg of the pair of legs 24 includes an opening 22 at its distal end 29. Each opening 22 contains a bearing (not shown), with the rods 12 passing through the bearings (not shown), and therefore openings 22, to slidingly secure the slide portion 20 with the base portion 10 with the smooth upper and lower surfaces 21, 11 aligned with one another.

In an embodiment, the bearings are linear bushings or bearings; however, any suitable bearing which facilitates movement of the sliding portion 20 along the rods 12 may be used. Movement of the slide portion 20 along the rods 12 is controlled by the shock absorber or damper 30. The damper 30 is connected to the base 10 and the rear of the slide sliding portion 20. Any suitable shock absorber or damper may be used. Optionally, the damper 30 may include a magnet or a "mag stop" or an air charge cylinder to resist and help control the movement of the slide portion 20 in relation to a mounted firearm.

Figure 3:
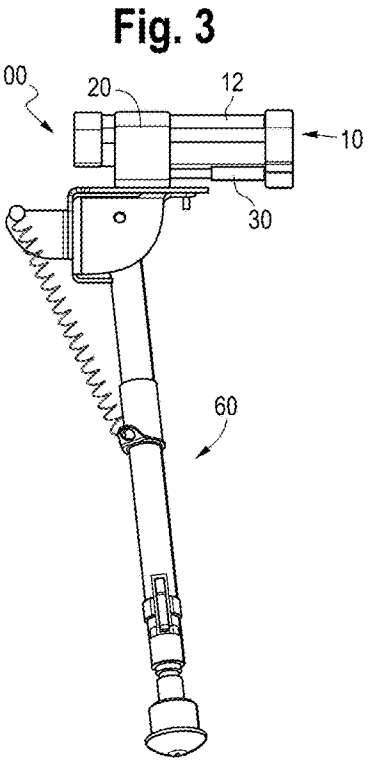
FIG. 3 is a side view of FIG. 2.
Figure 4:
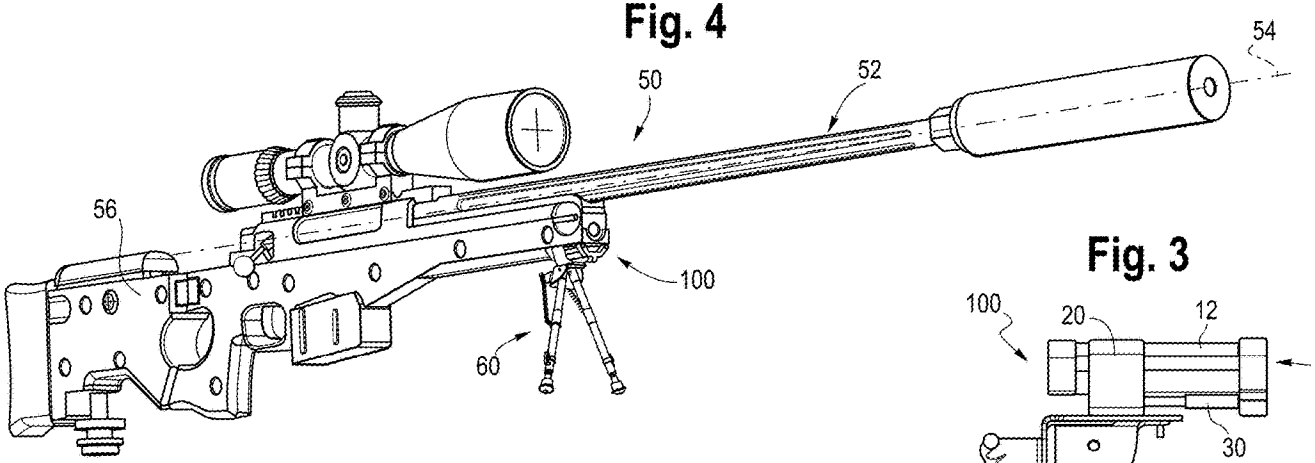
FIG. 4 is a perspective view of the recoil control system attached to a firearm in accordance with embodiments of the present disclosure.

In the embodiment shown in FIG. 1, the base portion 10 includes a mounting hole 15 on the bottom surface 11 of its main body 13 and the slide portion 20 includes a mounting hole 25 on its main body 23. The mounting holes 15, 25 are used to secure the system (directly or indirectly) to at least a portion of a firearm (in the case of mounting hole 15) and at least a portion of a support (in the case of mounting hole 25), as shown in FIGS. 2-4. In such embodiments, the recoil control system 100 may come with hardware (e.g., screws, etc.) which engage the mounting holes 15, 25 and attach the system 100 to the appropriate portion of a firearm and/or support. In further embodiments, however, the recoil control system 100 may secure to at least a portion of a firearm and/or support using other methods and/or structures which will be appreciated by those of skill in the art. For example, as shown in FIGS. 5A-7B, and with particular reference to FIGS. 5A-5E, the base portion 10 and slide portion 20 may be configured to secure to the firearm and/or support via a picatinny connection such as known in the art.

Figure 5A:
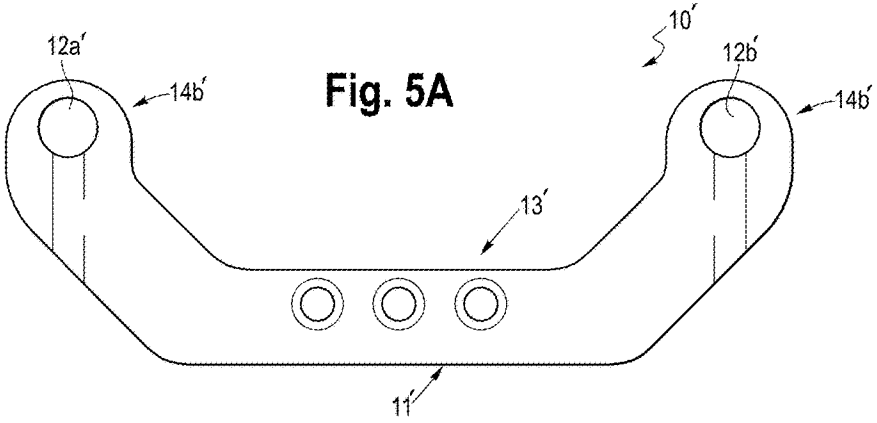
FIGS. 5A-5E illustrate a second embodiment of a recoil control system in accordance with embodiments of the present disclosure.
Figure 5C:
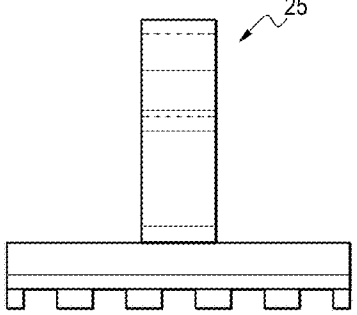
Figure 5D:
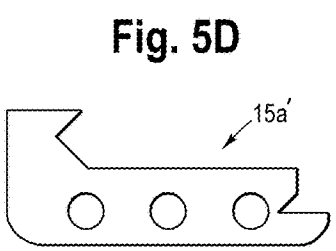
Figure 5E:
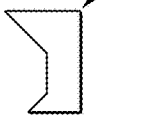
Figure 5B:
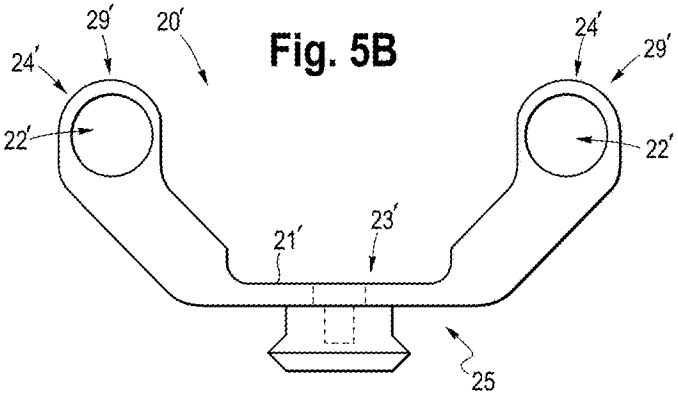
Figure 7B:
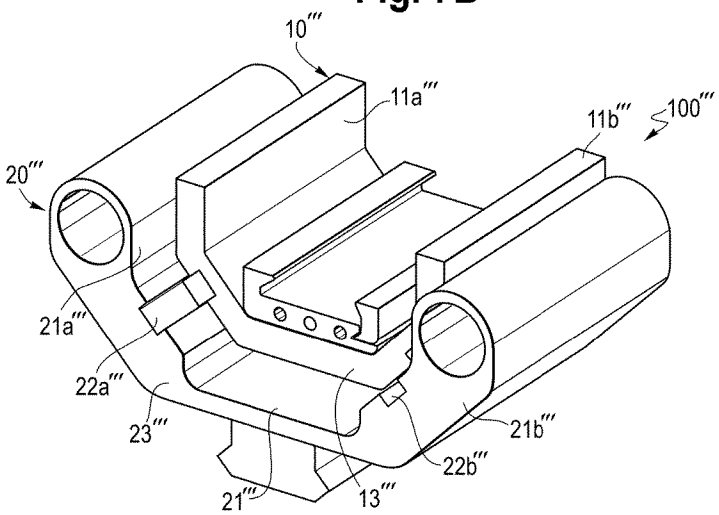
FIG. 7B is a perspective view of the recoil control system of FIG. 8A.
Figure 7A:
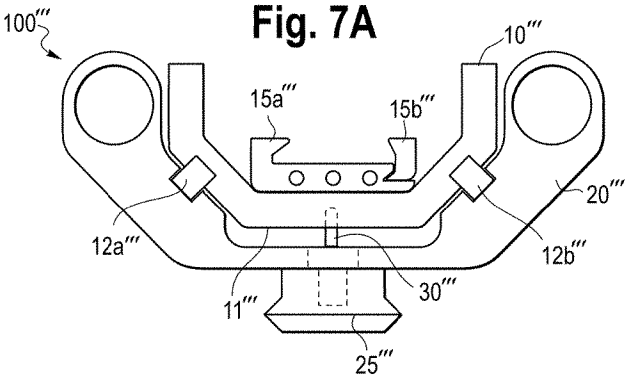
FIG. 7A is a front view of a fourth embodiment of a recoil control system in accordance with embodiments of the present disclosure.

With particular reference to FIGS. 5A-5E, a base portion 10' and slide portion 20', substantially similar to base portion 10 and slide portion 20, are shown being configured with structures adapted to secure to the firearm and support, respectively, via a picatinny connection. As shown in FIG. 5A, specifically, base portion 10' does not include a mounting hole, but rather is configured for use with picatinny connection portions 15*a*' and 15*b*' shown in FIGS. 5B and 5C, respectively. Similarly, as shown in FIGS. 5D and 5E, slide portion 20' does not include a mounting hole, but rather is configured to secure to a support (e.g., a bipod) via picatinny connection portion 25'. FIGS. 7A and 7B illustrate the use of picatinny connection portions 15*a*',15*b*' and 25' in further detail.

With the exception of the picatinny connection portions 15*a*', 15*b*' and 25', it will be appreciated that base portion 10' and slide portion 20' are substantially similar to base portion 10 and slide portion 20. That is, as shown in FIG. 5A, base portion includes a main body 13' with a smooth bottom surface 11' and two pairs of legs 14*a*' (not shown), 14*b*' extending upwardly away from the main body 13' at an angle. Like described with reference to FIG. 1, the at least one structure 12' providing a sliding interface between the bae portion 10' and the slide portion 20' is composed of two sliding rods 12*a*', 12*b*' (not shown) extend between the pairs of legs 14*a*', 14*b*' parallel with the length of the body 13'. Similarly, the slide portion 20' includes a main body 23' with a smooth upper surface 21', a single pair of legs 24' extending upwardly away from the main body 23' at an angle, and an opening 22' through the distal end 29' of each leg of the pair of legs 24' which contains a bearing (not shown) configured to receive the rods 12*a*', 12*b*' of the base 10'. Upon comparison of FIG. 1 with FIGS. 5A-5E, it will be understood that the geometry or shape of the of the base 10/10' and slides 20/20' may vary provided both components can still properly engage and function with one another.

In the embodiments shown in FIGS. 1-5E, the at least one structure 12/12' providing a sliding interface between the base portion 10/10' and the slide portion 20/20' is composed of two rods. However, in other embodiments, the at least one structure providing a sliding interface between the base portion and the slide portion may be another structure or combination of structures which secures the base and slide portions together and permits the slide portion to move forward and backward with respect to the base portion. For example, FIGS. 6 and 7A-7B illustrate alternative embodiments of a recoil control system 100", 100'" in which the at least one structure providing a sliding interface between the base portion and the slide portion is composed of at least one machined or profiled surface.

Figure 6:
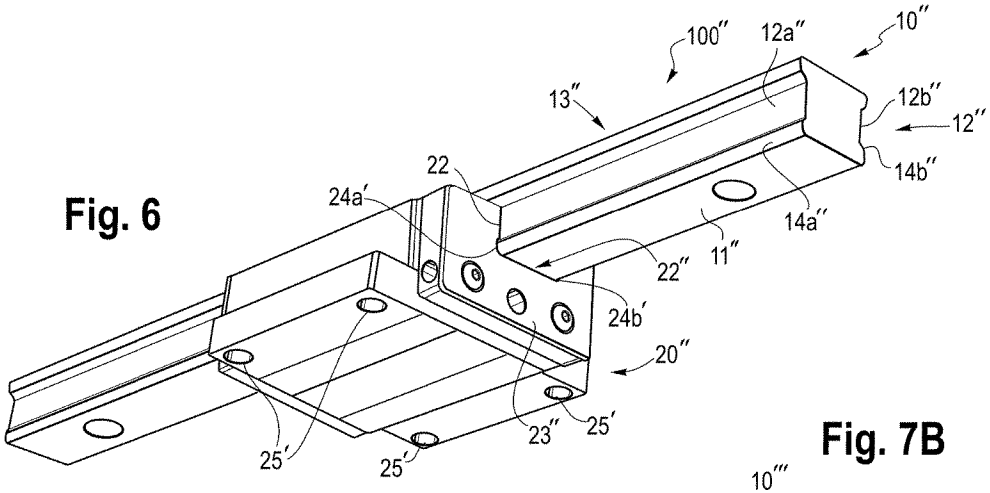
FIG. 6 is a perspective view of a third embodiment of a recoil control system in accordance with embodiments of the present disclosure.

Referring in particular to FIG. 6, a recoil control system 100" is shown having a base portion 10" and a slide portion 20". The base portion 10" and slide portion 20" can be configured to secure to at least a portion of a firearm and support, respectively, using any suitable structure or method, as discussed above (e.g., mounting holes/hardware, picatinny structures, etc.). Moreover, base portion 10" and slide portion 20" have many similar structures compared to base portion 10/10' and slide portion 20/20'. As shown in FIG. 6, the at least one structure 12" providing a sliding interface between the base portion 10" and the slide portion 20" is composed of a machined surface forming a contoured section extending the length of the main body 13" of the base portion 10". In some embodiments, this style of structure 12" may be referred to as a rail.

In the embodiment shown, base portion 10" has a main body 13" with a smooth bottom surface 11". Rather than having a pair of legs and a pair of sliding rods, the base portion 10" includes the machined surface (rail) 12" which, in the embodiment shown, is integrated with the main body 13" itself. While the rail 12" can take on any structure or configuration which provides a sliding interface between the base portion 10" and the slide portion 20", the rail 12" of the recoil control system 100" shown in FIG. 6 has a dovetail-like structure and includes first and second indentations 12*a*", 12*b*" and first and second flanges 14*a*", 14*b*". The rail 12" runs the length of the main body 13" forming a track or rail along which the slide portion 20" moves forward and backward.

Slide portion 20" also has a main body 23". In an embodiment, such as shown in FIG. 6, the length of the main body 23" is less than the length of main body 13". The main body 23" has a smooth upper surface 21" (not shown) which corresponds to the smooth lower surface 11" of the base portion 10". The slide portion 20" also includes a channel 22" which engages the rail 12" of the base portion 10". Specifically, the channel 22" has a shape which follows the contours of the rail 12" such that the channel 22" has wider bottom portions 24*a*" (not shown), 24*b*" (corresponding to the first and second flanges 14*a*", 14*b*") and narrow mid portions 22*a*", 22*b*" (corresponding to the first and second indentations 12*a*", 12*b*"). It will be appreciated that the channel 22" may take a different shape or structure depending on the specific structures, shape and/or configuration of the rail 12" of the base portion 10". In some embodiments, the channel 22" may include one or more bearings which facilitate movement of the slide portion 20" relative to the base portion 10".

Like the embodiment shown in FIGS. 1-4, the recoil control system 100" of FIG. 6 includes mounting holes 15" (not shown) and 25" to secure the recoil control system 100" to at least a portion of a firearm and support.

A damper 30" (not shown) may be in communication with the slide portion 20" as described above.

FIGS. 7A and 7B illustrate a further exemplary embodiment of a recoil control system 100'" having features of both recoil control system 100 and recoil control system 100". As illustrated in FIG. 7A, the recoil control system 100'" has base portion 10'" and slide portion 20'" with a damper 30' positioned internally, i.e., inside the recoil control system 100'". The recoil control system 100'" is configured to secure to at least a portion of a firearm and at least a portion of a support via a picatinny connection and therefore includes picatinny connection portions 15*a*'",15*b*'" and 25'" (shown in further detail in FIGS. 5B-5E).

Recoil control system 100'" also includes at least one structure 12'" providing a sliding interface between the base portion 10'" and the slide portion 20'" which, in the embodiment shown, is composed of two machined surfaces 12*a*'", 12*b*'" forming two contoured sections running the length of the main body 13'" of the base portion 10'". Again, this style of structure 12'" may be referred to, in some embodiments, as rails.

In the embodiment shown, the base portion 10'" is similar to slide portion 10 and slide portion 20'" is similar to slide portion 20. Base portion 10' has a main body 13'" with a smooth bottom surface 11'". The main body 13'" also includes two side walls 11*a*'" and 11*b*'" which extend upwardly away from the surface 11'" at an angle. The two rails or contoured structure/sections 12'" are integrated with the main body 13" itself. Specifically, as shown in FIG. 7A, the rails 12' are each integrated with a respective one of the side walls 11*a*'", 11*b*'" and run the length of the sidewall 11*a*'", 11*b*'". As described with reference to FIG. 6, above, while the rails 12'" can take on any structure or configuration which provides a sliding interface between the base portion 10'" and the slide portion 20'", the rails 12' of the recoil control system 100'" shown in FIGS. 7A and 7B have a dovetail-like structure and include first and second indentations 12*a*", 12*b*" (not shown) and first and second flanges 14*a*", 14*b*" (not shown). The rails 12'" run the length of the main body 13' forming a pair of tracks or rails along which the slide portion 20'" moves forward and backward.

Slide portion 20' also has a main body 23'" In an embodiment, such as shown in FIG. 7B, the length of the main body 23'" is approximately equal to the length of main body 13'". The main body 23'" has a smooth upper surface 21'", which corresponds to the smooth lower surface 11'" of the base portion 10'", and two sidewalls 21*a*'" and 21*b*'" which extend upwardly from the surface 21'" at an angle. In an embodiment, the angle is within 5° of the angle at which the sidewalls 11*a*'" and 11*b*'" extend from the surface 11'" of the base portion 10'".

The slide portion 20'" also includes a pair of channels 22*a*', 22*b*' which each engage a respective one of the rails 12'" of the base portion 10'". Specifically, the channels 22*a*'", 22*b*'" have a shape which follows the contours of the rails 12'" such that the channels 22*a*'", 22*b*'" each have a wider bottom portion 24*a*''' (not shown) corresponding to the first and second flanges 14*a*''', 14*b*''' and a narrow mid portion 24*b*''' (not shown) corresponding to the first and second indentations 12*a*''', 12*b*'''. It will be appreciated that the channels 22''' may take a different shape or structure depending on the specific structures, shape and/or configuration of the rails 12''' of the base portion 10'''. In some embodiments, the channels 22''' may include one or more bearings which facilitate movement of the slide portion 20''' relative to the base portion 10'''.

Turning again to FIGS. 2-4, as shown, the system 100 mounts to the bottom of the stock 56 of the firearm 50 using the mounting hole 15 and corresponding hardware. In some embodiments, the system 100 may also include adjustment screws or similar structures to allow a user to adjust the system 100 to be parallel to the axis of the barrel 54. In other embodiments, the system 100 may work in tandem with a secondary feature provided on the stock 56.

The system 100 controls the movement of a firearm 50 supported by a bipod 60 during recoil. The system 100 is used as an interface between the bipod 60 and the firearm 50 to reduce the possibility of bipod hop or bouncing during recoil and to aid in accuracy. During the recoil phase of a shot, the system 100 permits the bipod 60 to move independently of the firearm 50. In other words, because the firearm 50 is secured to the base 10 of the system 100, the base 10 moves with the firearm 50 during recoil. The sliding engagement of the base 10 and the sliding portion 20 reduces the amount of movement of the bipod 60 and the damper 30 reduces the amount of recoil movement experienced in total.

Figure 8:
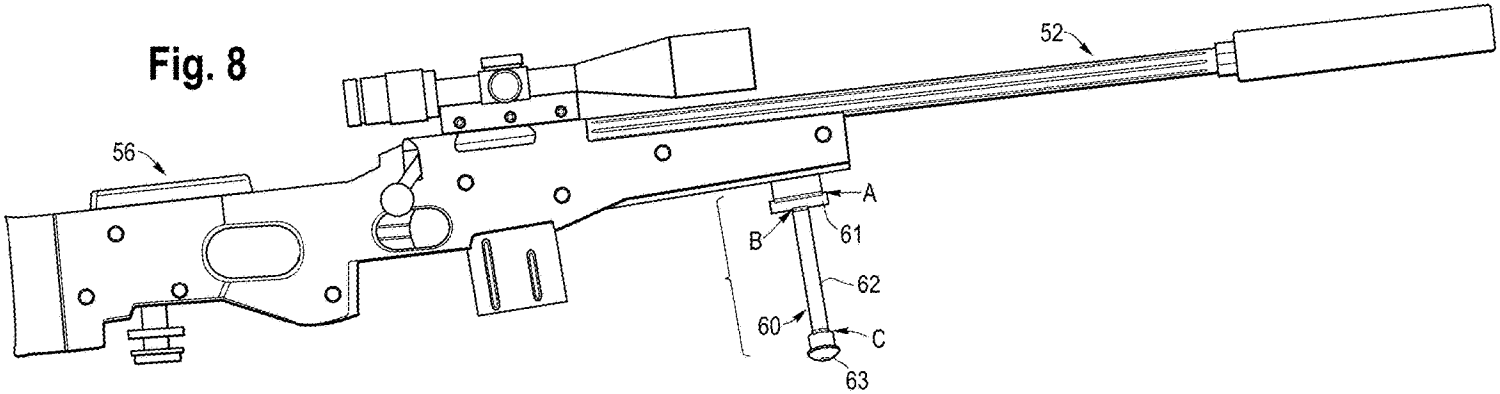
FIGS. 8-9 are side view schematics illustrating different positioning of a recoil control system with respect to a support and firearm in accordance with embodiments of the present disclosure.

In the embodiment shown in FIG. 4, the system 100 is positioned so as to provide a sliding interface directly between the firearm 50 and the bipod 60. In other words, instead of attaching the bipod 60 directly to the firearm 50, the system 100 is secured to the firearm 50 and the bipod 60 is secured to the system 100 using the mounting head 61 of the bipod, as shown by A in FIG. 8. However, in further exemplary embodiments, and with reference to FIG. 8, the system 100 may be so positioned and/or configured so as to provide a sliding interface between the legs 62 of a bipod 60 and the body of the bipod 60 that is secured to the firearm 50 (B). In still further embodiments, the system 100 may be so positioned and/or configured so as to provide a sliding interface between the feet 63 of the bipod 60 and the legs 62 of the bipod 60 (C).

Figure 9:
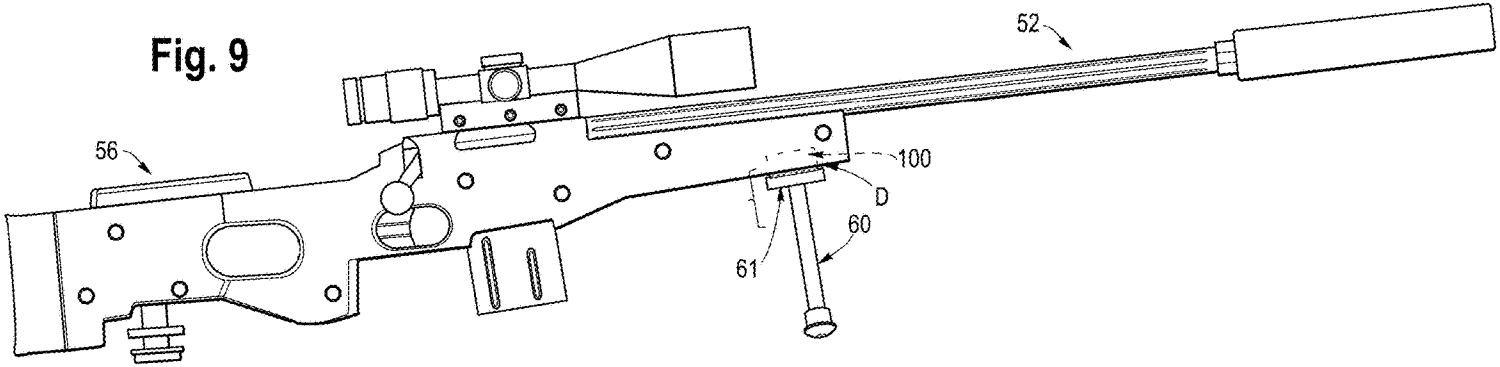

In still further embodiments, and with reference to FIG. 9, the system may further be positioned and/or configured to mount internally with respect to the firearm 50. Although the sliding interface between the firearm 50 and the bipod 60 will be located internally on the firearm 50, e.g., inside the stock 56, the sliding surface is still formed between the firearm 50 and the bipod 60 (D). In such an embodiment, the damper 30 would be contained internally with respect to the firearm 50 as well.

While the above discussion references system 100 only, it will be appreciated that the same discussion with respect to the different positioning possibilities applies equally to all embodiments of the recoil control system described herein, including systems 100', 100" and 100'''.

While the exact dimensions of the system 100, and the individual components of the system 100, may vary based on a number of factors, including, for example, the particular firearm, type of bipod/stationary platform, etc., generally, the dimensions of the system 100 will remain consistent within a range. In an embodiment, the base 10 has a thickness (from the bottom surface 11 to its upper surface) of from 0.200 inches, or 0.250 inches, or 0.300 inches, or 0.350 inches to 0.500 inches, or 0.450 inches, or 0.400 inches. In particular embodiment, the thickness of the base 10 is 0.375 inches.

In an embodiment, the base 10 has a length of from 3.00 inches, or 3.25 inches, or 3.5 inches, or 3.75 inches to 5.00 inches, or 4.75 inches, or 4.25 inches. In an embodiment, the base 10 has a length of 4.00 inches.

In embodiments in which the system 100 includes a pair of legs (or sidewalls), the thickness of the legs of the pairs of legs 14*a*, 14*b* (or sidewalls) is from 0.500 inches, or 0.475 inches, or 0.450 inches to 0.375 inches, or 0.400 inches, or 0.425 inches. In a particular embodiment, the thickness of the legs of the pairs of legs 14*a*, 14*b* (or sidewalls) is 0.4381 inches.

In an embodiment in which the at least one structure 12 is a pair of rods 12*a*, 12*b*, the distance from the center of one rod 12 to the center of the other rod 12 is from 2.000 inches, or 2.200 inches, or 2.400 inches to 3.000 inches, or 3.800 inches, or 3.700 inches. In a particular embodiment, the distance from the center of one rod 12 to the center of the other rod 12 is 2.625 inches.

In an embodiment in which the at least one structure 12 is a pair of rails or contoured structures/sections 12*a*'''/12*b*''', the distance from the center of one rail or contoured structure/section 12*a*''' to the center of the other 12*b*''' is from 2.000 inches, or 2.200 inches, or 2.400 inches to 3.000 inches, or 3.800 inches, or 3.700 inches. In a particular embodiment, the distance from the center of one rail or contoured structure/section 12*a*''' to the center of the other 12*b*''' is 2.625 inches.

In an embodiment, the total width of the base 10 is from 2.700 inches, or 2.800 inches, or 2.900 inches to 3.750 inches, or 3.500 inches, or 3.250 inches. In a particular embodiment, the total width of the base 10 is 3.1250 inches.

In an embodiment, the width of the base 10 between the legs in the pairs of legs 14*a*, 14*b* (or sidewalls) is from 1.000 inches, or 1.250 inches, or 1.500 inches, or 1.750 inches to 2.750 inches, or 2.500 inches, or 2.250 inches. In a particular embodiment, the width of the base 10 between the legs in the pairs of legs 14*a*,14*b* (or sidewalls) is 2.1250 inches.

In an embodiment, the height of the legs of the pairs of legs 14*a*,14*b* (or sidewalls), as measured from the bottom surface 11 of the base 10 to the top of the legs (or sidewalls), is from 2.000 inches, or 1.750 inches, or 1.500 inches or 1.250 inches to 0.500 inches, or 0.750 inches, or 1.000 inches. In a particular embodiment, the height of the legs of the pairs of legs 14*a*, 14*b* (or sidewalls), as measured from the bottom surface 11 of the base 10 to the top of the legs (or sidewalls), is 1.1250 inches. In an embodiment, the height of the legs as measured from the bottom surface 11 of the base 10 to the center of the rod 12 is from 0.500 inches, or 0.600 inches, or 0.700 inches, or 0.800 inches to 1.300 inches, or 1.200 inches, or 1.100 inches, or 1.000 inches. In a particular embodiment, the height of the legs as of the pairs of legs 14*a*. 14*b*, as measured from the bottom surface 11 of the base 10 to the center of the rod 12 is 0.9375 inches.

In embodiments in which the at least one structure 12 is at least two rods, the diameter of the rods is from 0.100 inches, or 0.150 inches, or 0.200 inches to 1.000 inches, or 0.800 inches or 0.600 inches. In a particular embodiment, the diameter of the rods 12 is 0.2362 inches.

In an embodiment, the slide portion 20 has a thickness (from the bottom surface to its upper surface 21) of from 0.050 inches, or 0.075 inches, or 0.100 inches, or 0.200 inches to 0.500 inches, or 0.400 inches, or 0.300 inches, or 0.200 inches. In particular embodiment, the thickness of the slide portion 20 is 0.1245 inches. In another particular embodiment, the thickness of the slide portion 20 is 0.375 inches.

In embodiments in which the slide portion 20 includes a pair of legs 24 (or sidewalls), the thickness of the legs of the pair of legs 24 (or sidewalls) is from 0.500 inches, or 0.475 inches, or 0.450 inches to 0.375 inches, or 0.400 inches, or 0.420 inches. In a particular embodiment, the thickness of the legs of the pair of legs 24 is 0.4225 inches.

In an embodiment, the total width of the slide portion 20 is from 2.700 inches, or 2.800 inches, or 2.900 inches to 4.000 inches, or 3.750 inches, or 3.500 inches. In a particular embodiment, the total width of the slide portion 20 is 3.2500 inches.

In an embodiment, the slide portion 20 has a length of from 3.00 inches, or 3.25 inches, or 3.5 inches, or 3.75 inches to 5.00 inches, or 4.75 inches, or 4.25 inches. In an embodiment, the base 10 has a length of 4.00 inches.

In an embodiment, the distance from the center of one opening 22 to the center of the other opening 22 (or from the center of one sidewall to the other) is from 2.000 inches, or 2.250 inches, or 2.500 inches to 3.000 inches, or 2.900 inches, or 2.800 inches, or 2.700 inches. In a particular embodiment, the distance from the center of one opening 22 to the center of the other opening 22 (or center of one sidewall to the center of the other) is 2.6250 inches.

In an embodiment, the width of the slide portion 20 between the legs in the pair of legs 24 (or between sidewalls) is from 1.000 inches, or 1.250 inches, or 1.500 inches, or 1.750 inches to 2.750 inches, or 2.500 inches, or 2.250 inches. In a particular embodiment, the width of the base 10 between the legs in the pair of legs 24 (or between sidewalls) is 2.0640 inches.

In an embodiment, the width of the upper surface 11 is from 0.500 inches, or 0.750 inches, or 1.000 inches, or 1.250 inches to 2.000 inches, or 1.750 inches, or 1.500 inches. In a particular embodiment, the width of the upper surface 11 is 1.2900 inches.

In an embodiment, the height of the legs of the pair of legs 24 (or sidewalls), as measured from the bottom-most point of the slide portion 20 to the top of the legs (or sidewalls), is from 2.000 inches, or 1.900 inches, or 1.800 inches or 1.700 inches to 0.500 inches, or 0.750 inches, or 1.000 inches. In a particular embodiment, the height of the legs of the pair of legs 24 (or sidewalls), as measured from the bottom-most point of the slide portion 20 to the top of the legs (or sidewalls), is 1.6570 inches.

In an embodiment, the height of the legs as measured from the upper surface 21 of the slide portion 20 to the center of the openings 22 is from 0.500 inches, or 0.600 inches, or 0.700 inches, or 0.800 inches to 1.300 inches, or 1.200 inches, or 1.100 inches, or 1.000 inches. In a particular embodiment, the height of the legs as of the pair of legs 24, as measured from the upper surface 21 of the slide portion 20 to the center of the openings 22 is 0.8455 inches. In an embodiment, the height of the legs as measured from the bottom-most point of the slide portion 20 to the center of the openings 22 is from 0.800 inches, or 0.900 inches, or 1.000 inches, or 1.100 inches to 2.000 inches, or 1.750 inches, or 1.500 inches. In a particular embodiment, the height of the legs of the pair of legs 24 as measured from the bottom-most point of the slide portion 20 to the center of the openings 22 is 1.3445 inches.

In an embodiment, the base 10, rods 12 and slide 20 may made of any suitable material including, but not limited to, aluminum, steel, nylon, or carbon composite. Similarly, the system 100 may be made by any suitable means including milling, forging, stamping or 3D printing. Any holes or contours may be made by drilling, milling and/or any other suitable method. In one embodiment, the holes are drilled and reamed and, optionally, milled out to fit all additional parts. Additional parts may include, for example, leveling pads and screws to allow a shooter to adjust the axis of the slide portion 20 to ensure that it is parallel to the axis 54 of the barrel 52. The system 100 may also include additional lightening features to reduce the overall weight of the system 100.

While the above discussions relating to exemplary dimensions, materials and manufacturing are described with respect to recoil control system 100 only, it will be appreciated that the same discussion with respect to the different positioning possibilities applies equally to all embodiments of the recoil control system described herein, including systems 100', 100" and 100'''.

Figure 10:
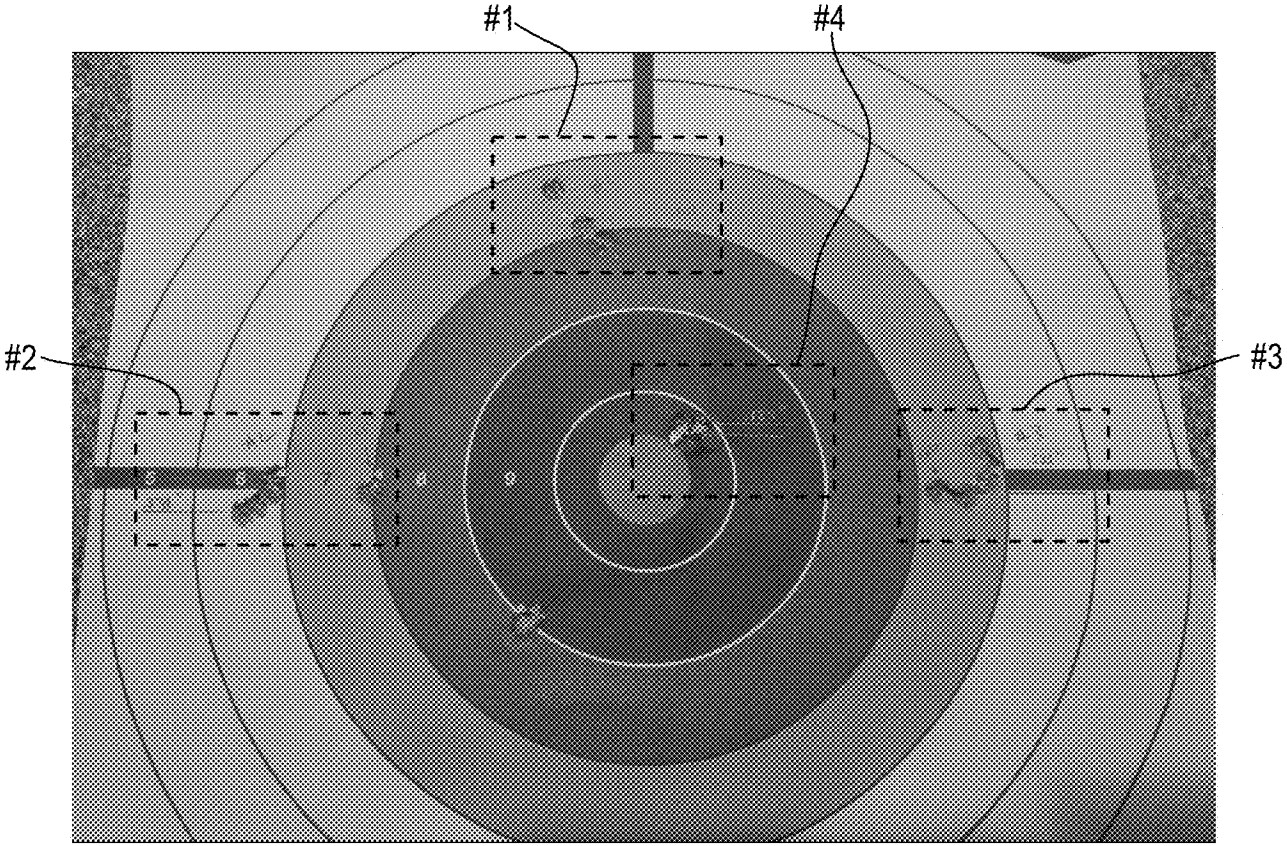
FIGS. 10-12 show test result data as further explained below.
Figure 11:
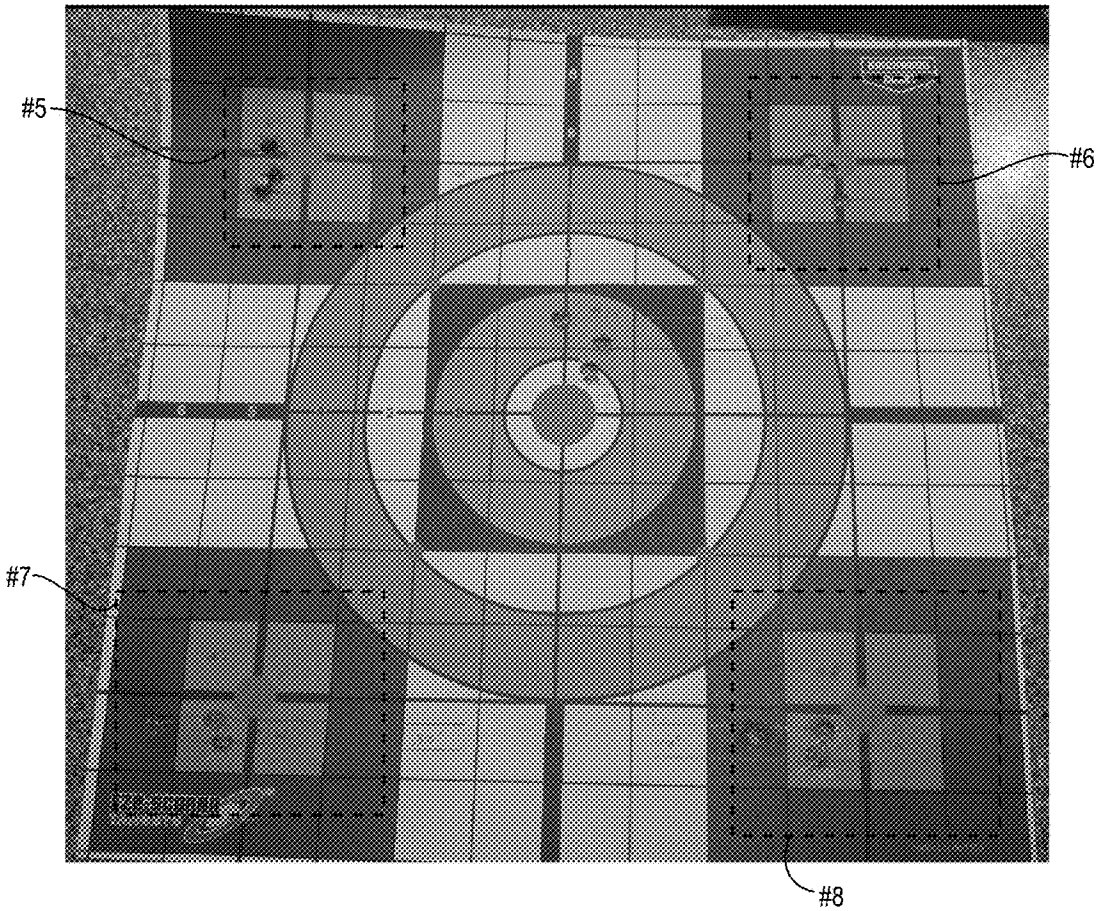
Figure 12:
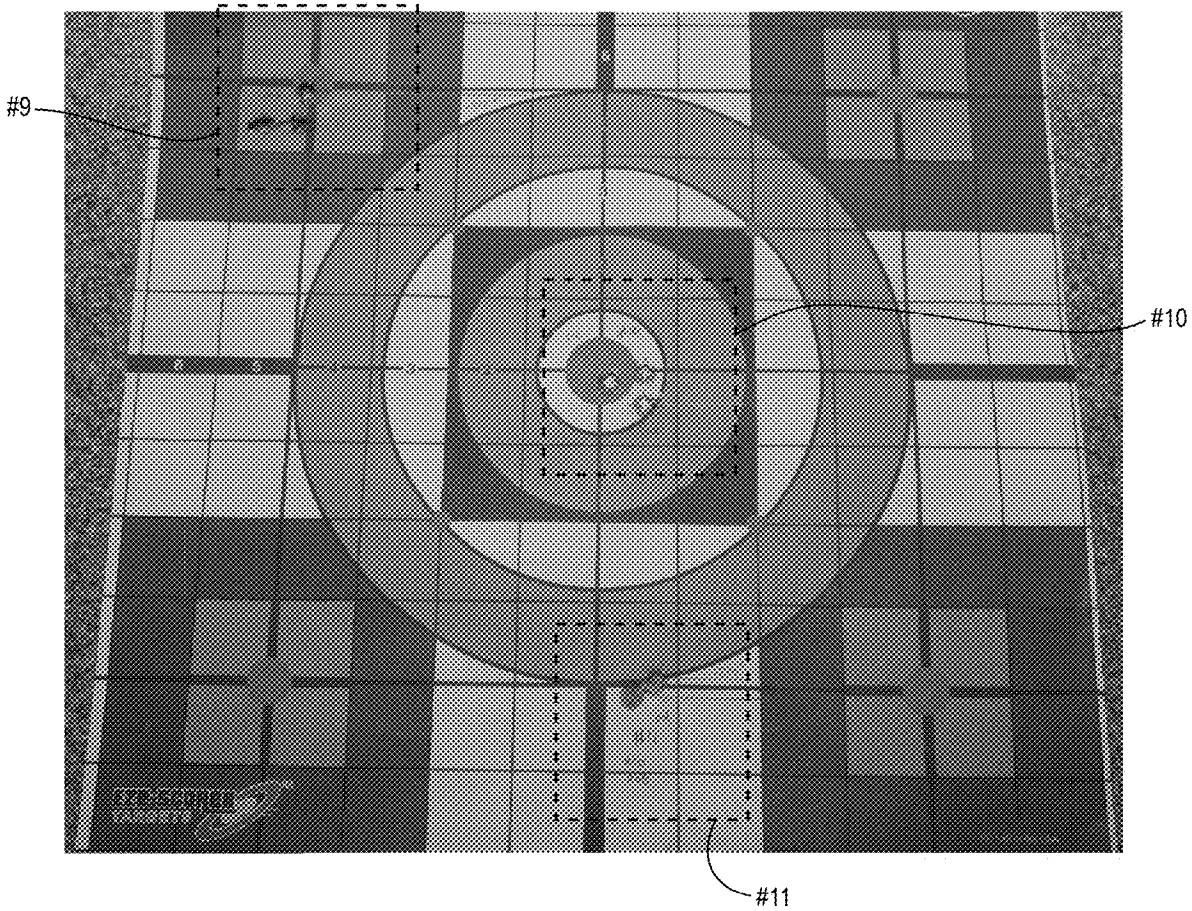

FIGS. 10-12 are photographs showing shot clusters obtained using the system 100 and without using the system 100, as described in further detail below.

The tests are completed using a Savage Model 10 Rifle, .308 caliber, with a Vortex Razor 5×20×50 scope. A 9-13" adjustable Harris bipod was used with all tests. The ammunition is Applied Ballistics Munitions 185 gr Berger Match Juggernaut Target. The distance between the shooter and target is 100 yards. Two different versions of the system 100 are tested and each described below:

System 1: a recoil control system having a structure and configuration consistent with recoil control system 100'''

System 2: a recoil control system having a structure and configuration consistent with recoil control system 100"

Both systems are positioned as shown in FIG. 4 to provide a sliding surface directly between the firearm and the bipod.

The testing conditions for each trial is provided in the table below along with the results of those tests.

| Test # | Ground Type | Preloading? | System? | Vertical Spread (inches) |
|---|---|---|---|---|
| 1 | Flat | No | No | .631 |
| 2 | Flat | Yes | No | .378 |
| 3 | Flat | Yes | No | .535 |
| 4 | Flat | No | System 2 | .125 |
| 5 | Uneven | No | No | .700 |
| 6 | Uneven | No | No | .640 |
| 7 | Uneven | No | System 1 | .310 |
| 8 | Uneven | No | System 1 | .410 |
| 9 | Uneven | No | System 1 | .515 |
| 10 | Uneven | No | System 2 | .425 |
| 11 | Uneven | No | System 2 | .220 |

As summarized in the chart above, and visually shown in FIGS. 9-11, using any version of the recoil control system results in significantly reduced vertical spread. In particular, Tests 1-4 show that using the system in combination with a bipod on flat ground reduces vertical spread over 75%. Similarly, using the system in combination with a bipod on uneven ground reduces vertical spread by at least 10% with reductions of greater than 60% shown in the results in Table 1.

Moreover, while the vertical spread decreases considerable with both System 1 and System 2, it was unexpectedly discovered that System 2, having two rails, showed considerable improvement with respect to horizontal spread as compared to System 1.

Many other variations to the viewing optic interface, viewing optic, and related methods, and respective components, are possible and considered within the scope of the claims. Moreover, the components can be sized and shaped depending on the overall intended use and/or application of the squeegee and can be varied, to at least some extent, without departing from the scope of the present invention.

It is specifically intended that the present disclosure not be limited to the embodiments and illustrations contained herein, but include modified forms of those embodiments including portions of the embodiments and combinations of elements of different embodiments as come within the scope of the following claims.

What is claimed is:

1. A recoil control system comprising:

a base portion having a main body having a length, a flat bottom surface, and at least two machined contoured sections extending the length of the main body;

a slide portion having a main body with a flat upper surface;

wherein the at least two machined contoured sections provide a sliding interface between the base portion and the slide portion such that the slide portion is slidingly engaged with, and can move forward and backward with respect to, the base portion; and a damper in communication with the slide portion, wherein the at least two machined contoured sections each include one indentation and one flange and wherein the at least two machined contoured sections together form a single rail.

2. The recoil control system of claim 1, wherein the damper is connected to a rear portion of the main body of the base portion and a rear portion of the main body of the slide portion.

3. The recoil control system of claim 1, wherein the damper is internal to the system.

4. The recoil control system of claim 1, wherein the main body of the base portion further includes an attachment point for attachment to a firearm.

5. The recoil control system of claim 4, wherein the main body of the slide portion further includes an attachment point for attachment to a support.

6. A support for a firearm comprising:

a mounting head;

at least two legs connected to the mounting head, wherein each leg includes one foot at distal end thereof; and at least one recoil control system of claim 1.

7. The support of claim 6, wherein the mounting head is removably connected to the slide portion of the recoil control system.

8. The support of claim 6, wherein the base portion of the recoil control system is connected to the mounting head and the slide portion of the recoil control system is connected to the legs.

9. A recoil control system for a firearm comprising:

a firearm having a long barrel and a stock;

a support; and a recoil control device of claim 1.

10. A recoil control system comprising:

a base portion having a main body having a length, a flat bottom surface, and at least two machined contoured sections extending the length of the main body;

a slide portion having a main body with a flat upper surface;

wherein the at least two machined contoured sections provide a sliding interface between the base portion and the slide portion such that the slide portion is slidingly engaged with, and can move forward and backward with respect to, the base portion; and a damper in communication with the slide portion, wherein the at least two machined contoured sections each form a respective rail and wherein the slide portion includes two channels, each corresponding to a respective rail.

11. The recoil control system of claim 10, wherein the main body of the base portion further includes two sidewalls extending upwardly away from the bottom surface at an angle and the main body of the slide portion further includes two sidewalls extending upwardly away from the upper surface at an angle.

12. The recoil control system of claim 11, wherein each of the rails is integrally formed with a respective sidewall of the base portion and each of the channels is integrally formed with a corresponding respective sidewall of the slide portion.

13. The recoil control system of claim 10, wherein the damper is connected to a rear portion of the main body of the base portion and a rear portion of the main body of the slide portion.

14. The recoil control system of claim 10, wherein the damper is internal to the system.

15. The recoil control system of claim 10, wherein the main body of the base portion further includes an attachment point for attachment to a firearm.

16. A support for a firearm comprising:

a mounting head;

at least two legs connected to the mounting head, wherein each leg includes one foot at a distal end thereof; and at least one recoil control device of claim 10.

17. A recoil control system for a firearm comprising:

a firearm having a long barrel and a stock;

a support; and a recoil control device of claim 10.

18. A recoil control system comprising:

a base portion having a main body having a length, a flat bottom surface, two pairs of legs, and at least two rods extending the length of the main body;

a slide portion having a main body with a flat upper surface; and a damper in communication with the slide portion, wherein a first pair of the pairs of legs extends upwardly away from a front portion of the main body at an angle and a second pair of the pairs of legs extends upwardly away from a rear portion of the main body at an angle such that each of the legs of the second pair of legs is aligned with a leg of the first pair of legs and the at least two rods extend between distal ends of aligned legs of the first and second pairs of legs.

19. A support for a firearm comprising:

a mounting head;

at least two legs connected to the mounting head, wherein each leg includes one foot at a distal end thereof; and at least one recoil control system of claim 18.

* * * * *